US012146317B2

(12) United States Patent
Maclean

(10) Patent No.: US 12,146,317 B2
(45) Date of Patent: Nov. 19, 2024

(54) DRAINAGE DEVICE

(71) Applicant: Mr. JMAC Contracting Ltd., Burnaby (CA)

(72) Inventor: James A. Maclean, Burnaby (CA)

(73) Assignee: Mr. JMAC Contracting Ltd., Burnaby (CA)

( * ) Notice: Subject to any disclaimer, the term of this patent is extended or adjusted under 35 U.S.C. 154(b) by 386 days.

(21) Appl. No.: 17/741,181

(22) Filed: May 10, 2022

(65) Prior Publication Data

US 2023/0366198 A1 Nov. 16, 2023

(51) Int. Cl.
*E04B 1/70* (2006.01)

(52) U.S. Cl.
CPC ..... *E04B 1/7038* (2013.01)

(58) Field of Classification Search
CPC ... E04B 1/7038; E04B 1/7023; E02D 29/045; E02D 31/002
See application file for complete search history.

(56) References Cited

U.S. PATENT DOCUMENTS 3,613,323 A * 10/1971 Hreha ..... E04B 1/7023 52/607
4,869,032 A 9/1989 Geske
5,870,864 A * 2/1999 Snyder ..... E04B 1/70 52/302.1
6,105,323 A * 8/2000 Paulle ..... E04B 1/70 52/302.1
6,129,482 A 10/2000 Ditullio
7,226,241 B2 * 6/2007 DiTullio ..... E03F 1/003 405/49
7,806,627 B2 * 10/2010 DiTullio ..... E03F 1/003 405/49
8,297,005 B1 10/2012 Bramble et al.
2004/0184884 A1 * 9/2004 DiTullio ..... E03F 1/003 138/121
2006/0233612 A1 * 10/2006 DiTullio ..... E03F 1/003 405/46
2007/0044396 A1 3/2007 Janesky
2019/0145096 A1 * 5/2019 Guillaume ..... E04B 1/6803 52/302.1

* cited by examiner

*Primary Examiner* — Rodney Mintz
(74) *Attorney, Agent, or Firm* — Nexus Law Group LLP; Nicholas P. Toth

(57) ABSTRACT

A drainage device, system, and method for draining moisture at a wall adjacent to and projecting from a floor is provided. An elongated body extends arcuately above the floor and is attached to the floor to define a channel between the elongated body and the floor for receiving moisture from proximate the wall at a rearward end of the elongated body. A barrier is proximate the wall and defines an opening to the wall adjacent to the floor that is dimensioned complementarily to the elongated body for receiving the elongated body therein. A rear flange at the rearward end is dimensioned to be captively received between the wall and a barrier via the opening for allowing the moisture between the barrier and the wall to drain into the channel via the rearward end. A sealant seals the rear flange to the barrier.

18 Claims, 6 Drawing Sheets

DRAINAGE DEVICE

TECHNICAL FIELD

The disclosure relates generally to waterproofing systems, and more particularly to drainage devices, systems, and methods.

BACKGROUND

In perimeter drainage systems, water flowing down a wall, such as water flowing exterior to a building and adjacent to a below-grade wall of surrounding earth, is collected in a drainage channel running proximate to the wall. The channel is installed to cause the falling water therein to flow towards a sump, from where it can be pumped away.

Without proper waterproofing and drainage, a building may be damaged. Remediation of damage due to water pooling can be costly and time-consuming. Achieving cost-effective drainage, particularly during building construction, is desirable.

SUMMARY

In an aspect, the disclosure describes a drainage device for draining moisture. The drainage device includes an elongated body extending between forward and rearward ends of the elongated body along opposing sides of the elongated body, the elongated body defining an arcuate cross-section as viewed from the forward end and rearward ends such that the elongated body defines an open bottom extending between the opposing sides. The drainage device also includes a pair of side flanges extending from the elongated body along the opposing sides from the rearward end toward the forward end, the pair of side flanges being suitable for use in attaching the drainage device to a floor. The drainage device also includes a rear flange extending arcuately around the elongated body at the rearward end, the rear flange being suitable for being disposed against a wall adjacent to and projecting from the floor.

Implementations may include one or more of the following features. The rear flange may include a spacer above the elongated body projecting laterally away from a face of the rear flange and from the elongated body. The spacer may be suitable for spacing the elongated body away from the wall when the rear flange is disposed against the wall. The rear flange may include a dimpled backing defining a plurality of protrusions projecting laterally away from a face of the rear flange and from the elongated body. At least one protrusion of the plurality of protrusions may be formed above the elongated body. The dimpled backing may be suitable for spacing the elongated body away from the wall when the rear flange is disposed against the wall. Each side flange may be dimensioned to receive a plurality of fasteners to fasten the elongated body to the floor. The arcuate cross-section may be substantially U-shaped. The arcuate cross-section may be substantially parabolically shaped. The elongated body may define a semicylindrical surface. Each side flange may be suitable for receiving adhesive to attach the elongated body to the floor. Each side flange of the pair of side flanges may project away from a lower portion of the elongated body in opposing directions substantially within a bottom plane defined by the open bottom. The bottom plane may be substantially perpendicular to the lower portion, substantially perpendicular to a forward plane defined by the forward end, and substantially perpendicular to a rearward plane defined by the rearward end. The pair of side flanges may extend from the rearward end to the forward end. Implementations of the described aspects may include a device, a method or process, or assembly.

In an aspect, the disclosure describes a drainage system for draining moisture at a wall that is adjacent to and projects from a floor. The drainage system includes an elongated body extending between forward and rearward ends of the elongated body along opposing sides of the elongated body, the elongated body extending arcuately above the floor between the opposing sides disposed on and attached to the floor to define a channel between the elongated body and the floor for receiving moisture from proximate the wall at the rearward end. The drainage system also includes a barrier proximate the wall, the barrier having an opening to the wall adjacent to the floor that is dimensioned complementarily to the elongated body for receiving the elongated body into the opening. The drainage system also includes a rear flange extending around the elongated body at the rearward end, the rear flange being dimensioned to be captively received between the wall and the barrier via the opening for allowing the moisture between the barrier and the wall to drain into the channel via the rearward end.

Implementations may include one or more of the following features. The barrier may be substantially parallel to the wall and may include a dimpled backing defining a plurality of protrusions projecting laterally from a face of the barrier to space the face of the barrier away from the wall. The rear flange may include a dimpled backing defining a plurality of protrusions projecting laterally away from a face of the rear flange and from the elongated body towards the wall. The dimpled backing may space the elongated body away from the wall when the rear flange is disposed against the wall. The elongated body may extend substantially perpendicular to the wall such that the channel extends laterally away from the wall for draining the moisture away from the wall. A face of the rear flange may be substantially parallel to the wall. The elongated body may define an arcuate cross-section as viewed from the rearward end. The opening of the barrier may be shaped to receive the elongated body at the rearward end of the elongated body. The rear flange may be adjacent a non-opening portion of the barrier when the elongated body is received into the opening. The rear flange may extend arcuately and substantially completely around a circumferential length of the elongated body at the rearward end of the elongated body. The drainage system may further comprise a pair of side flanges extending from the elongated body along the opposing sides from the rearward end toward the forward end, the elongated body being attached to the floor by the pair of side flanges being attached to the floor. The elongated body may define an arcuate cross-section as viewed from the forward and rearward ends such that the elongated body defines an open bottom extending between the opposing sides. Each side flange of the pair of side flanges may project away from a lower portion of the elongated body adjacent to the open bottom in opposing directions substantially within a bottom plane defined by the open bottom. The bottom plane may be substantially perpendicular to the lower portion, substantially perpendicular to a forward plane defined by the forward end, and substantially perpendicular to a rearward plane defined by the rearward end. Implementations of the described aspects may include a device, a method or process, or assembly.

In an aspect, the disclosure describes a method of draining moisture at a wall adjacent to and projecting from a floor. The method of draining moisture includes attaching to the floor an elongated body extending between forward and rearward ends of the elongated body along opposing sides of the elongated body using a pair of side flanges extending from the elongated body along the opposing sides from the rearward end of the elongated body towards the forward end, when the elongated body is positioned on the floor such that the rearward end is proximal to the wall and the elongated body extends arcuately above the floor to define a channel between the elongated body and the floor. The method of draining moisture also includes captively receiving, between the wall and a barrier, a rear flange extending arcuately around the elongated body at the rearward end of the elongated body by disposing of a barrier proximate to the wall when the barrier has an opening to the wall adjacent the floor that is dimensioned complementarily to the elongated body for receiving the elongated body into the opening.

The method may further comprise sealing a face of the rear flange to the barrier using a sealant to form a seal. Implementations of the described aspects may include a device, a method or process, or assembly.

Embodiments can include combinations of the above features.

Further details of these and other aspects of the subject matter of this application will be apparent from the detailed description included below and the drawings.

DESCRIPTION OF THE DRAWINGS

Reference is now made to the accompanying drawings, in which.

DETAILED DESCRIPTION

The following disclosure relates to draining moisture, e.g. from foundations. In some embodiments, the devices, systems, and methods disclosed herein facilitate more convenient, faster, and more cost-effective devices, systems, and methods compared to existing devices, systems, and methods.

Aspects of various embodiments are described in relation to the figures.

Figure 1A:
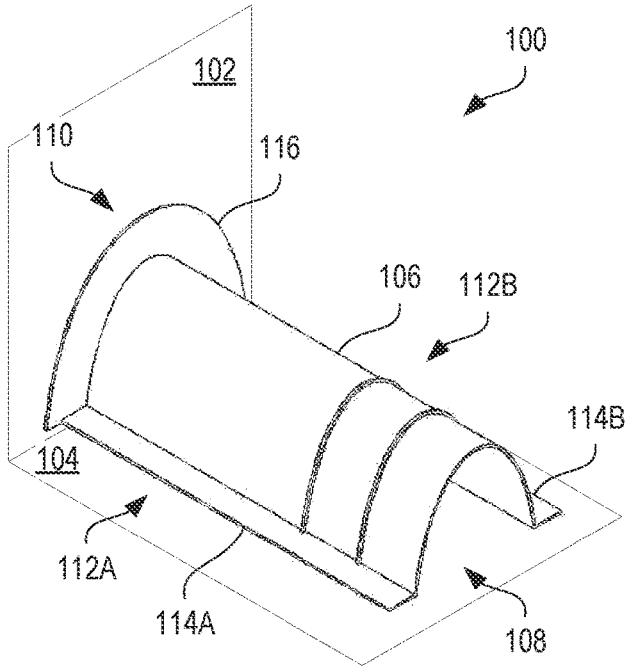
FIG. 1A is a perspective view of a drainage device positioned at a wall adjacent to and projecting from a floor, in accordance with an embodiment.
Figure 1B:
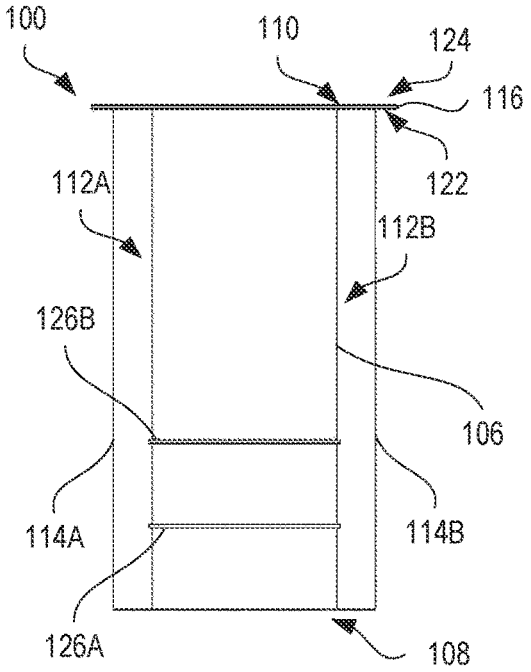
FIG. 1B is a top plan view of the drainage device of FIG. 1A.
Figure 1D:
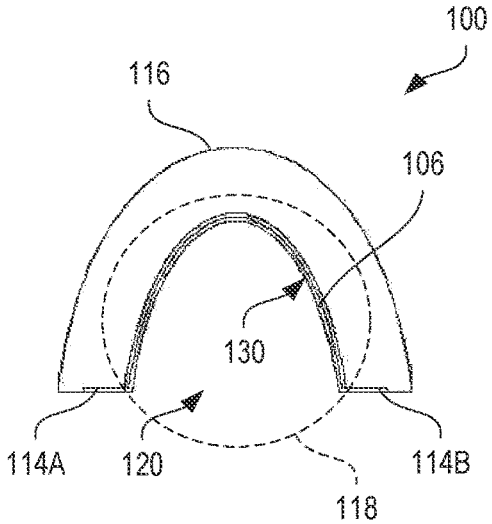
FIG. 1D is a front elevation view of the drainage device of FIG. 1A.
Figure 1C:
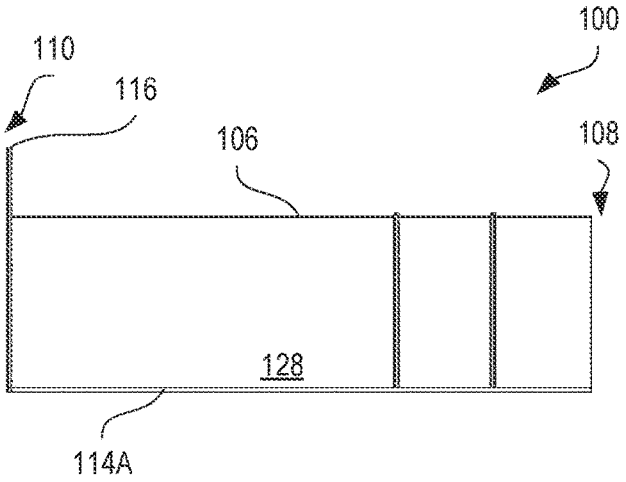
FIG. 1C is side elevation view of the drainage device of FIG. 1A.

FIGS. 1A-1D are various views of a drainage device 100, in accordance with an embodiment. In particular, FIG. 1A is a perspective view of the drainage device 100 proximate to a wall 102 that is adjacent to, and projecting from, a floor 104. FIG. 1B is a top plan view, FIG. 1C is side elevation view, and FIG. 1D is a front elevation view.

The drainage device 100 is suitable for draining moisture at the wall 102. FIG. 1A is illustrative of an exemplary positioning of the drainage device 100 relative to the wall 102 and the floor 104. For example, the wall 102 may be a dirt, stone, and/or shotcrete wall. The floor 104 is typically porous, such as aggregate rock and/or stone, as may be found at or beneath a concrete foundation of a building (not shown).

In various embodiments, the drainage device 100 may allow drainage of water or moisture from outside or exterior of the building into a location at the inside or interior of the building, e.g. an interior drain or sump. In various embodiments, the drainage device 100 may be fluidly connected to the location via a flow-through region. In various embodiments, the flow-through region may comprise high water flow material such as ¾" clear gravel. In some embodiments, the flow-through region may be a floor region having a gradient and defining an opening channel to allow the moisture to flow to the location under gravity. In various embodiments, a concrete slab may be disposed (directly) on or formed over the drainage device 100 and may form a finished floor of the building.

As shown in the embodiment of FIGS. 1A-1D, the drainage device 100 includes an elongated body 106. In some embodiments, the drainage device 100 includes a single elongated body 106. The elongated body 106 defines a forward end 108, a rearward end 110, a first side 112A, and second side 112B opposing the first side 112A. For example, the elongated body 106 may be semicylindrical or semitubular (an elongated tubular structure admitting a variety of cross-sectional shapes and defining an elongated open bottom).

Still referring to the embodiment shown in FIGS. 1A-1D, the drainage device 100 extends between forward and rearward ends 108, 110 along the opposing sides 112A, 112B of the elongated body 106. The elongated body 106 extends arcuately above the floor 104 between the opposing sides 112A, 112B. As described further below, the elongated body 106 may be attached or may be suitable to be attached to the floor 104 to define a channel between the elongated body 106 and the floor 104 for receiving moisture from proximate the wall 102 as the moistures falls downwards along the wall 102 adjacent to the drainage device 100 or otherwise fluidly connected to the drainage device 100 via a drainage gradient.

As shown in FIGS. 1A-1D, the elongated body 106 is connected to a first side flange 114A and a second side flange 114B of the drainage device 100 associated with the first side 112A and the second side 112B, respectively. The pair of side flanges 114A, 114B extend along the opposing sides 112A, 112B from the rearward end 110 toward the forward end 108, e.g. the side flanges 114A, 114B may extend a portion or all of the length between the forward end 108 and the rearward end 110.

In embodiments of FIGS. 1A-1D, the pair of side flanges 114A, 114B are suitable for attaching the elongated body 106 to the floor 104. In some embodiments, each side flange 114A, 114B may be dimensioned to receive a plurality of fasteners to fasten the elongated body 106 to the floor 104. In some embodiments, each side flange 114A, 114B (or one or more of the side flanges 114A, 114B) may include or may be suitable for receiving adhesive to adhere the elongated body 106 to the floor 104.

Still referring to the embodiment shown in FIGS. 1A-1D, the elongated body 106 is connected to a rear flange 116 extending arcuately around the elongated body 106 at the rearward end 110 thereof. The rear flange 116 defines a front face 122 and a rear face 124. The front face 122 is suitable for receiving a barrier, adhesive, or protrusion during installation of a drainage system using the drainage device 100. The rear face 124 is suitable for being disposed against the wall 102.

In various embodiments, the rear flange 116 extends arcuately and substantially completely around a circumferential length 130 of the elongated body 106 at the rearward end 110 of the elongated body 106.

The elongated body 106 defines an arcuate cross-section 118 as viewed from the rearward end 110 and/or the forward end 108 such that the elongated body 106 defines an open bottom 120 that extends along (and between) the opposing sides 112A, 112B, as illustrated in FIG. 1C. The elongated body 106 and, in particular, a lower portion thereof is adjacent to the open bottom 120.

In various embodiments, the arcuate cross-section 118 is substantially U-shaped. In an exemplary embodiment, the arcuate cross-section 118 comprises two legs proximal to the opposing sides 112A, 112B, respectively. The two legs may extend vertically and may be connected to each other via an arc, an arcuate portion, or a convex portion.

In various embodiments, the arcuate cross-section 118 is substantially parabolically shaped. A parabolic shape curves downward and away from a center such that the opposing ends defining the parabolic shape are further away from the center horizontally than any other point of the shape. Such an outspreading shape is suitable for supporting a large load on the elongated body 106.

In some embodiments, the elongated body 106 defines a semicylindrical surface such that the arcuate cross-section 118 is semicircular.

In various embodiments, a cross-sectional shape of the elongated body 106 viewed from the forward end 108 may be distinct from, or the same as, a cross-sectional shape viewed from the rearward end 110, e.g. their dimensions may be different and/or general profile shapes. In some embodiments, a cross-sectional shape of the elongated body 106 viewed from the forward end 108 is smaller than a cross-sectional shape viewed from the rearward end 110.

In some embodiments, ribs 126A, 126B extend radially outwardly from the elongated body 106. In some embodiments, the ribs 126A, 126B are dimensioned in accordance with the elongated body 106, such as being 8" (approx. 200 mm) and 10" (approx. 254 mm) away from the rear flange 116, thereby providing a convenient distance indicator for use during installation. For example, the ribs may be aligned with surrounding fixtures or other environmental features for ease of correct placement of the elongated body 106 or the rear flange 116, and/or may be used as a measurement tool when cutting the elongated body 106 in cases where a shorter elongated body 106 is desirable. The ribs 126A, 126B advantageously strengthen the elongated body 106 to better hold its shape. In at least the embodiment shown in FIGS. 1A-1D, the ribs 126A, 126B are arcuate.

In some embodiments, the open bottom 120 is substantially perpendicular to a lower portion 128 of the elongated body 106 adjacent to the open bottom 120. In some embodiments, each of the side flanges 114A, 114B project away from the lower portion 128 in opposing directions substantially within a bottom plane defined by the open bottom 120, e.g. see FIG. 1A.

In various embodiments, the bottom plane may be substantially perpendicular to the lower portion 128 and/or substantially perpendicular to a forward plane defined by the forward end 108 and substantially perpendicular to a rearward plane defined a rearward end 110. In various embodiments, the forward plane and/or the rearward plane may be normal to the side flanges 114A, 114B.

In various embodiments, advantageously, the elongated body 106, the side flanges 114A, 114B, and/or the rear flange 116 may be in unitary construction or integrally coupled to each other. In some embodiments, one or more components may be constructed of a hard polymer, e.g. high density polyethylene (HDPE), and/or sheet metal. In the embodiment of FIGS. 1A-1D, the side flanges 114A, 114B are suitable for use in attaching the drainage device 100 to the floor 104.

Figure 2B:
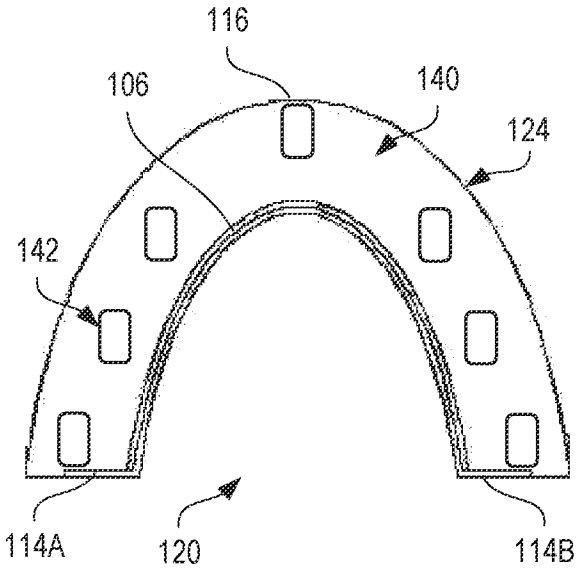
FIG. 2B is a rear elevation view of a drainage device with a dimpled backing, in accordance with an embodiment.
Figure 2A:
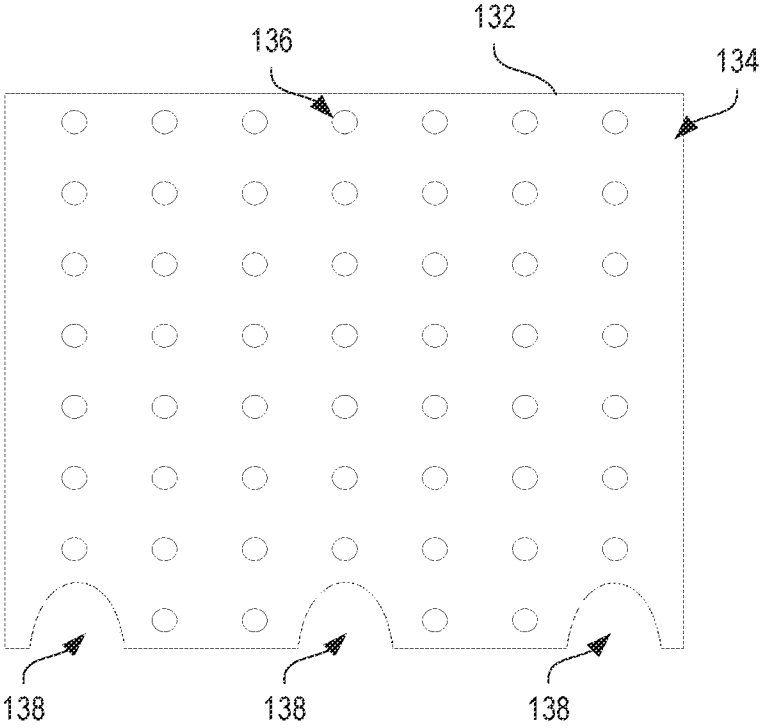
FIG. 2A is a rear elevation view of a barrier with a dimpled backing, in accordance with an embodiment.

FIG. 2A is a rear elevation view of a barrier 132 with a dimpled backing 134, in accordance with an embodiment.

FIG. 2B is a rear elevation view of a drainage device 100 with a dimpled backing 140, in accordance with an embodiment.

In embodiments associated with FIGS. 2A-2B, the barrier 132 is suitable for use in a drainage system for draining moisture at the wall 102. The barrier 132 is suitable to be disposed over or proximate to the wall 102. In some embodiments, the barrier 132 extends substantially parallel to the wall 102.

In a typical installation, the barrier 132 is spaced apart from the wall 102. In some embodiments, the barrier 132 has a dimpled backing 134. The dimpled backing 134 defines a plurality of protrusions 136 projecting laterally from a face of the barrier 132 to space the face of the barrier away from the wall 102 when the barrier 132 is set against the wall 102 with one or more of the protrusions 136 contacting the wall 102.

In various embodiments, the barrier 132 may be a waterproof barrier. In some embodiments, the dimpled backing 134 may be adhered to a rigid barrier 132, e.g. using a sealant.

In some embodiments, the barrier 132 defines opening(s) 138 to the wall 102 dimensioned complementarily to the elongated body 106 to receive the elongated body 106 therein at the rearward end 110 of the elongated body 106 such that the rear flange 116 is interposed or sandwiched between the wall 102 and the barrier 132. Typically, the opening(s) 138 of the barrier are shaped in accordance with the arcuate cross-section 118 and may even frictionally engage the elongated body 106. When the rear flange 116 is sandwiched between the wall 102 and the barrier 132, the barrier 132 defines non-opening portion(s) adjacent to the opening(s) 138 that captively hold the rear flange 116. The non-opening portion(s) may or may not have protrusions 136.

In the embodiment shown in FIG. 2B, the rear flange 116 has installed thereon the dimpled backing 140. For example, the dimpled backing 140 may be adhered on to the rear flange 116. It is understood that in some embodiments, no dimpled backing is provided on the rear flange 116.

The dimpled backing 140 is suitable for spacing the elongated body 106 away from the wall 102 when the rear flange 116 is disposed against the wall 102.

The dimpled backing 140 defines a plurality of protrusions 142 projecting laterally away from the rear face 124 of the rear flange 116. The protrusions 142 project towards the wall 102 when the drainage device 100 is installed against the wall 102. In some embodiments, the protrusions 142 are formed, such as by plastic injection molding or pressing into sheet metal, in the material of the rear flange 116.

Advantageously in some embodiments, at least one protrusion of the plurality of protrusions 142 is formed above the elongated body 106. For example, achieving spacing of the rear flange 116 from the wall 102 may be achieved compactly.

The dimpled backing 134, 140 is in some embodiments a dimpled (waterproofing) membrane. In some embodiments, the dimpled backing 134, 140 is available commercially off-the-shelf to facilitate manufacturing and assembly. In some embodiments, the dimpled backing 134, 140 is constructed of high-density polyethylene (HDPE). In some embodiments, the barrier 132 and/or dimpled backing 134, 140 is resiliently flexible. In various embodiments, the barrier 132 and/or the dimpled backing 134, 140 permits cutting thereof, e.g. using a utility knife. For example, the openings 138 may be formed by cutting.

Figure 3B:
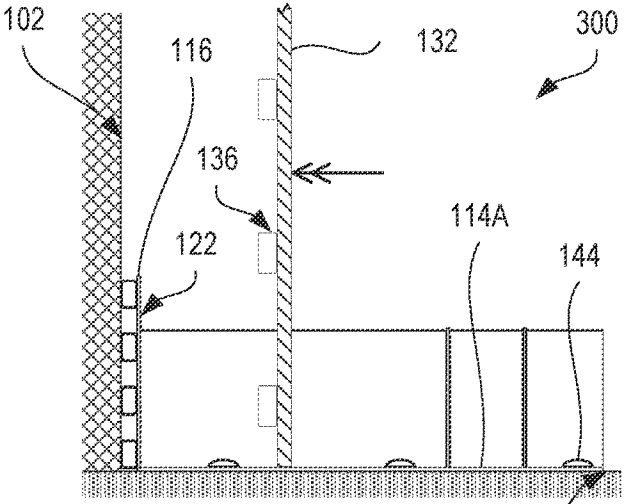
FIG. 3B is a schematic cross-sectional view of the drainage system of FIG. 3A at a second stage of installation thereof.
Figure 3C:
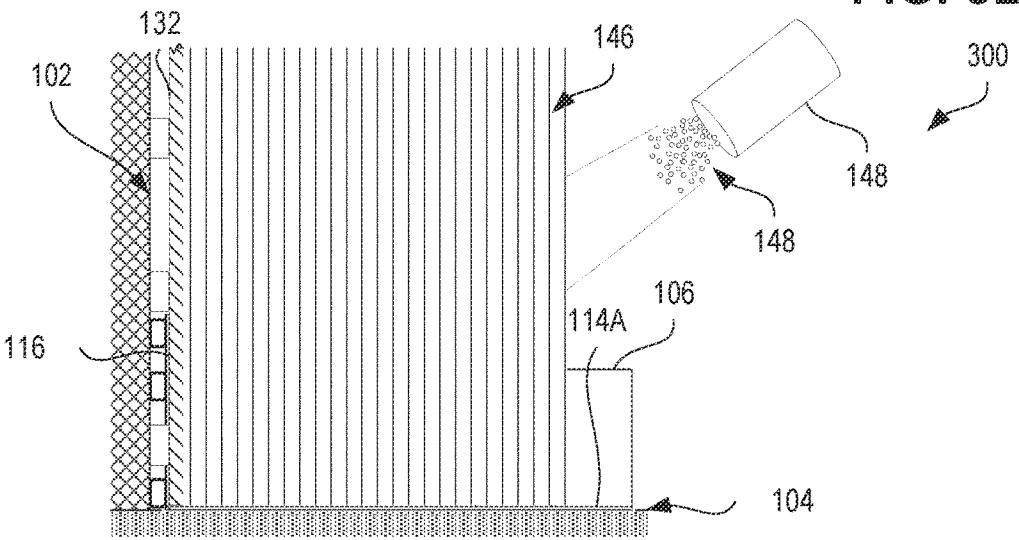
FIG. 3C is a schematic cross-sectional view of the drainage system of FIG. 3A and FIG. 3B at a third stage of installation thereof.
Figure 3A:
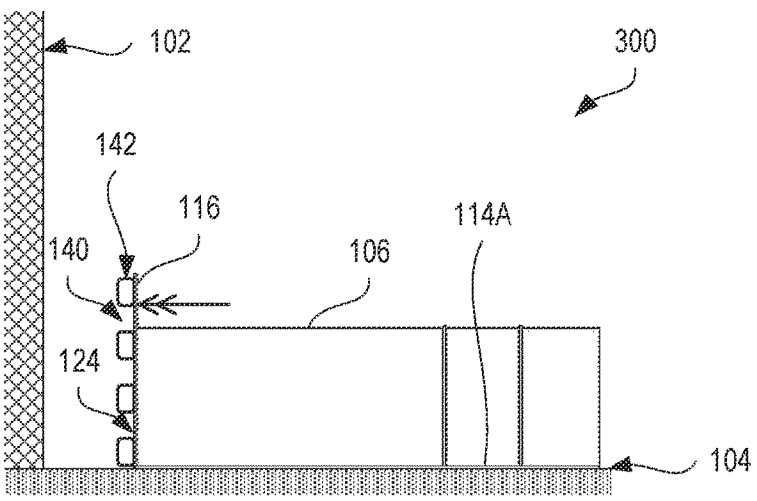
FIG. 3A is a schematic cross-sectional view of a drainage system at a first stage of installation thereof, in accordance with an embodiment.

In reference to FIG. 3A, during a first stage of installation of a drainage system 300 according to an embodiment of the system 300, the elongated body 106 is positioned substantially perpendicular to the wall 102 and pushed against the wall, as shown by double-headed arrows in FIG. 3A, until the plurality of protrusions 142 are proximate to or pushed against the wall 102. The face 124 of the rear flange 116 is typically substantially parallel to the wall 102. Such a positioning forms a channel in the elongated body 106 that extends laterally away from the wall 102 to drain moisture away from the wall 102.

Once positioned as described, the elongated body 106 is attached to the floor 104 by attaching the pair of side flanges 114A, 114B to the floor 104. In some embodiments, the elongated body 106 is fastened to the floor using fasteners 144 such as nails, rivets, and/or threaded fasteners. Additionally or alternatively, the elongated body 106 may be adhered or otherwise attached to the floor using adhesive or other suitable attachment techniques. The side flanges 114A, 114B are typically attached flat onto the floor 104. Advantageously, such positioning and attaching of the elongated body 106 can be performed quickly, e.g. precise positioning and ensuring sealed gaps is typically not necessary at this stage.

In reference to FIG. 3B, during a second stage of the installation of the drainage system 300, the barrier 132 is disposed over the elongated body 106 and moved against the wall 102 so that the barrier 132 is proximate to the wall 102. The barrier 132 may be disposed over the drainage device 100 in such a manner as to cause the openings 138 to be engaged with the elongated body 106 (e.g. at a portion of an upper wall thereof). In some embodiments, the openings 138 may be complementarily dimensioned relative to the elongated body 106 so that a snug fit is achieved therebetween. For example, the elongated body 106 may thereby be frictionally engaged with the barrier 132. However, in many embodiments such frictional engagement is not necessary for proper operation of the drainage system 300.

In some installations, the barrier 132 is slid between rebar (not shown) and the wall 102, which in some cases will retainably secure the barrier 132 against the wall 102.

Pushing the barrier 132 against the wall 102 typically has the effect of pushing a rear face of the barrier 132 against the rear flange 116. The rear flange 116 is preferably adjacent to non-opening portion(s) of the barrier 132. In some cases, a sealant is applied onto the rear flange 116 to seal the rear flange 116 against the barrier 132. In some embodiments, the size of the rear flange 116 is dimensioned based on dimpled backing 134 of the barrier 132. For example, the openings 138 may be dimensioned to allow the rear flange 116 to contact a face of the dimpled backing 134 (and/or barrier 132) and not the plurality of protrusions 136. It is understood that the plurality of protrusions 136 may or may not be touching the wall 102 when the barrier 132 is pushed against the wall 102. In some embodiments, the rear flange 116 is substantially fully covered by the barrier 132 when the elongated body 106 is received into the opening 138.

In the embodiment of FIGS. 3A-3B, the rear flange 116 is suitable, or dimensional, for being captively received or retained between the wall 102 and the barrier 132 via the opening 138. This allows moisture between the barrier 132 and the wall 102 to drain into the channel via the rearward end 110 of the elongated body 106.

In reference to FIG. 3C, during a third stage of the installation of the drainage system 300 according to some embodiments, concrete 146 is formed over the elongated body 106. In some embodiments, the concrete 146 is formed by applying a spray 148 of concrete via a nozzle 150 or other applicator.

Figure 4B:
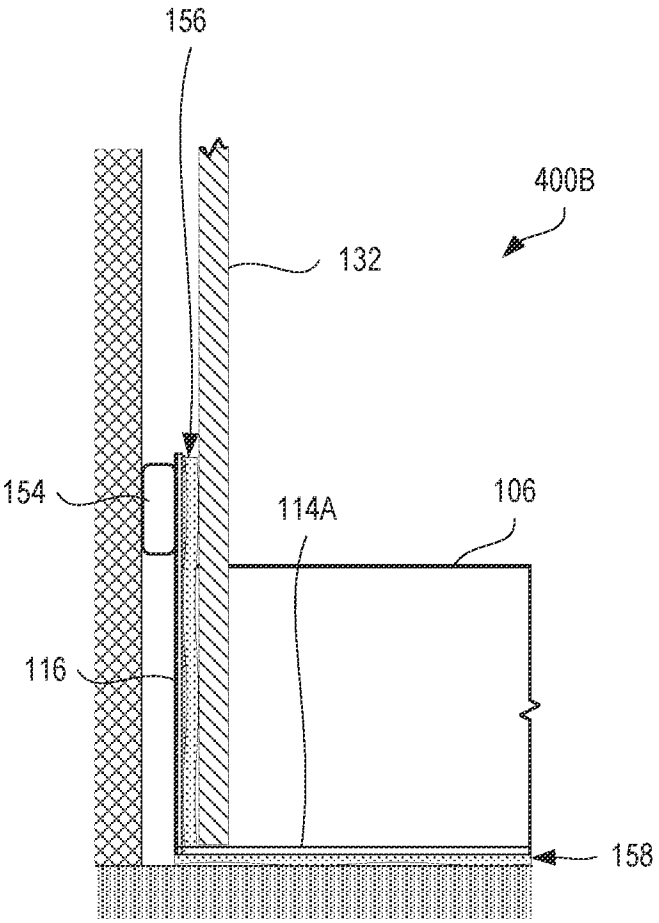
FIG. 4B is a schematic cross-sectional view of a drainage system installed against a smooth wall, in accordance with an embodiment.
Figure 4A:
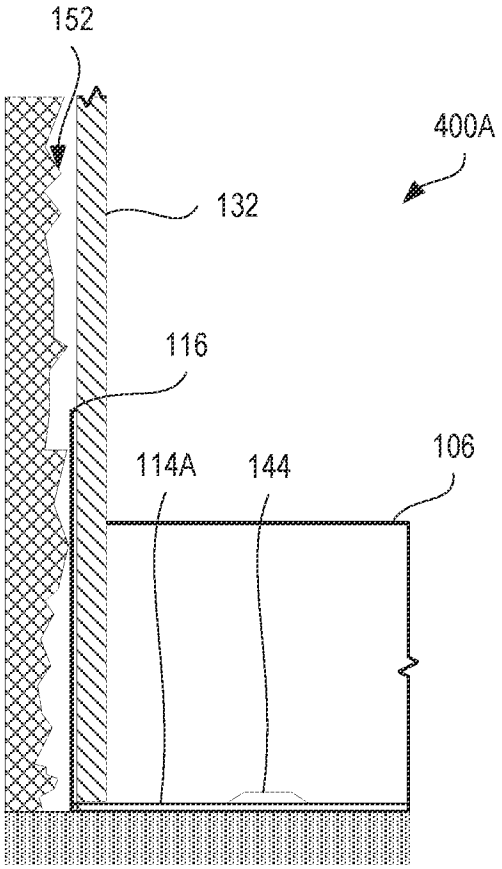
FIG. 4A is a schematic cross-sectional view of a drainage system installed against a rough wall, in accordance with an embodiment.

FIG. 4A is a schematic cross-sectional view of a drainage system 400A installed against a wall 102 having roughness 152, in accordance with an embodiment.

In the system 400A, the rear flange 116 and the barrier 132 are both free of protrusions for spacing the respective components away from each other and the wall 102. Instead, the wall 102 has sufficient roughness 152 defining a plurality of roughness elements that serve to space the rear flange 116 away from the wall. The rear flange 116 thus spaces the barrier 132 away from the wall. In variations, the roughness 152 may be formed intentionally, e.g. by spraying concrete or by implementing other type(s) of constructed roughness (es).

FIG. 4B is a schematic cross-sectional view of a drainage system 400B installed against a smooth wall 102. In general, the drainage system 400A may the same as or different from the drainage system 400B.

In the system 400B, the rear flange 116 is in some embodiments coupled to a spacer 154. When a spacer 154 is employed, the barrier 132 need not have a dimpled backing. The spacer 154 is preferably disposed above the elongated body 106 projecting laterally away from a face 124 of the rear flange 116 and from the elongated body 106. The spacer 154 is suitable for spacing the elongated body 106 away from the wall 102 when the rear flange 116 is disposed against the wall 102. In a variation of the system 400B of FIG. 4B, the spacer 154 is not employed and the rear flange 116 is dimpled such that protrusions 142 project laterally away from the rear face 124 of the rear flange 116 toward the wall 102.

As shown in FIG. 4B, a first adhesive 156 adhesively couples the rear flange 116 to the barrier 132. For example, the first adhesive 156 may be a sealant to establish a waterproof seal between the rear flange 116 and the barrier 132. Also, in some embodiments a second adhesive 158 adhesively couples the side flanges 114A, 114B to the floor 104 to attach the elongated body 106 to the floor 104. The first adhesive 156 and the second adhesive 158 may be PL400™ adhesive, for example.

In various embodiments, the rear flange 116 may be at least partially overlapping with the barrier 132, e.g. to facilitate creation of a seal between the rear flange 116 and the barrier 132.

In some embodiments, the rear flange 116 is adhesively coupled to the dimpled backing 134, e.g. to a protrusion of the dimpled backing 134.

In some embodiments, the rear flange 116 is spaced a distance away from the wall 102, such as to accommodate an expected flow volume into the drainage channel. The distance is in some embodiments within the range of 0.25" (approx. 6.4 mm) to 2" (approx. 51 mm), and is 0.5" (12.7 mm) in some embodiments for example.

In some embodiments, the barrier 132, with the dimpled backing 134, may be provided with cut-outs at a lower end thereof that are adapted to allow or facilitate flow of moisture therethrough, and then positioned or disposed against the wall 102. The rear flange 116 may be then attached, fastened, and/or adhered to the barrier 132 at an outward face thereof such that the dimpled backing 134 spaces the drainage device 100 away from the wall 102 and the cut-outs in the barrier 132 fluidly connect a region adjacent to the wall 102 to a channel formed between the elongated body 106 and the floor 104 to allow moisture to flow from the wall 102 through the channel for drainage.

Figure 5:
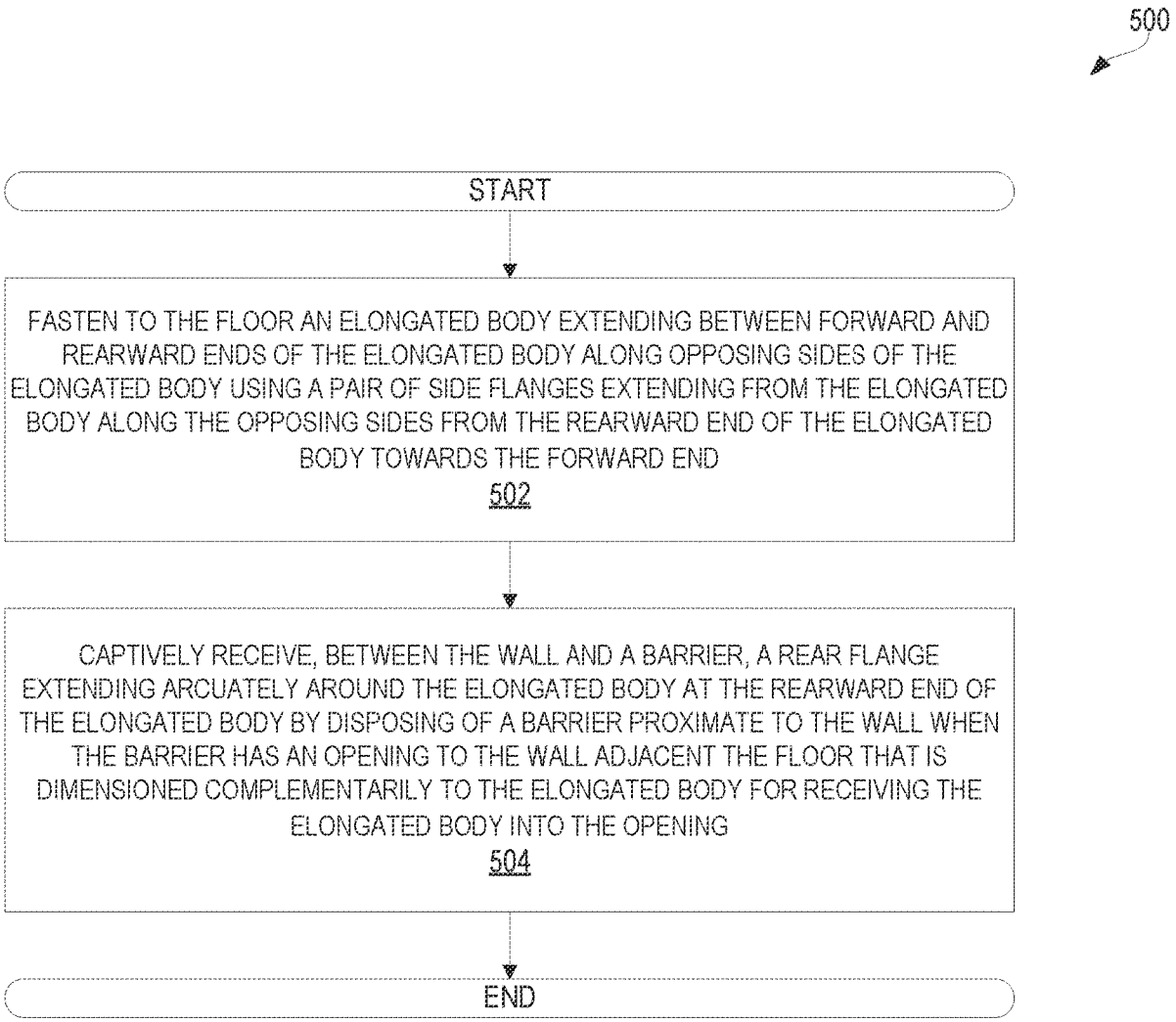
FIG. 5 is a flow chart of a method of draining moisture at a wall adjacent to and projecting from a floor, in accordance with an embodiment.

FIG. 5 is a flow chart a method 500 of draining moisture at a wall adjacent to and projecting from a floor, in accordance with an embodiment.

Step 502 of the method 500 includes attaching to the floor an elongated body extending between forward and rearward ends of the elongated body along opposing sides of the elongated body using a pair of side flanges extending from the elongated body along the opposing sides from the rearward end of the elongated body towards the forward end, when the elongated body is positioned on the floor such that the rearward end is proximal to the wall and the elongated body extends arcuately above the floor to define a channel between the elongated body and the floor.

Step 504 of the method 500 includes captively receiving, between the wall and a barrier, a rear flange extending arcuately around the elongated body at the rearward end of the elongated body by disposing of a barrier proximate to the wall when the barrier has an opening to the wall adjacent the floor that is dimensioned complementarily to the elongated body for receiving the elongated body into the opening.

Some embodiments of the method 500 includes adhering a face of the rear flange to the barrier using a sealant to form a seal.

In an exemplary implementation, the drainage system 400A (FIG. 4A) or 400B (FIG. 4B) is achieved by installing the exemplary embodiment of the drainage device 100 (FIGS. 1A-1D) having side flanges 114A, 114B by attaching the side flanges 114A, 114B to the floor, e.g. by nailing or using adhesive (e.g. PL400™ adhesive) to glue the side flanges 114A, 114B to the floor; then installing the barrier 132, which may be a dimple board 132 for example, by making cut-outs in the dimple board 132 to fit the location and size of the elongated body 106 of the drainage device 100; then (while installing the dimple board 132) applying sealant 156 (FIG. 4B) to the front side 122 of the rear flange 116 (FIG. 1B); then sliding the dimple board 132 between the rebar (if any, not shown) and the dirt/shotcrete wall 102; then pressing the backside of the dimple board 132 against the front side 122 of the rear flange 116 to contact the sealant 156; and then finally shooting concrete against the dimple board 132 (with device 100, dimple board 132 and sealant 156 in place).

Figure 6:
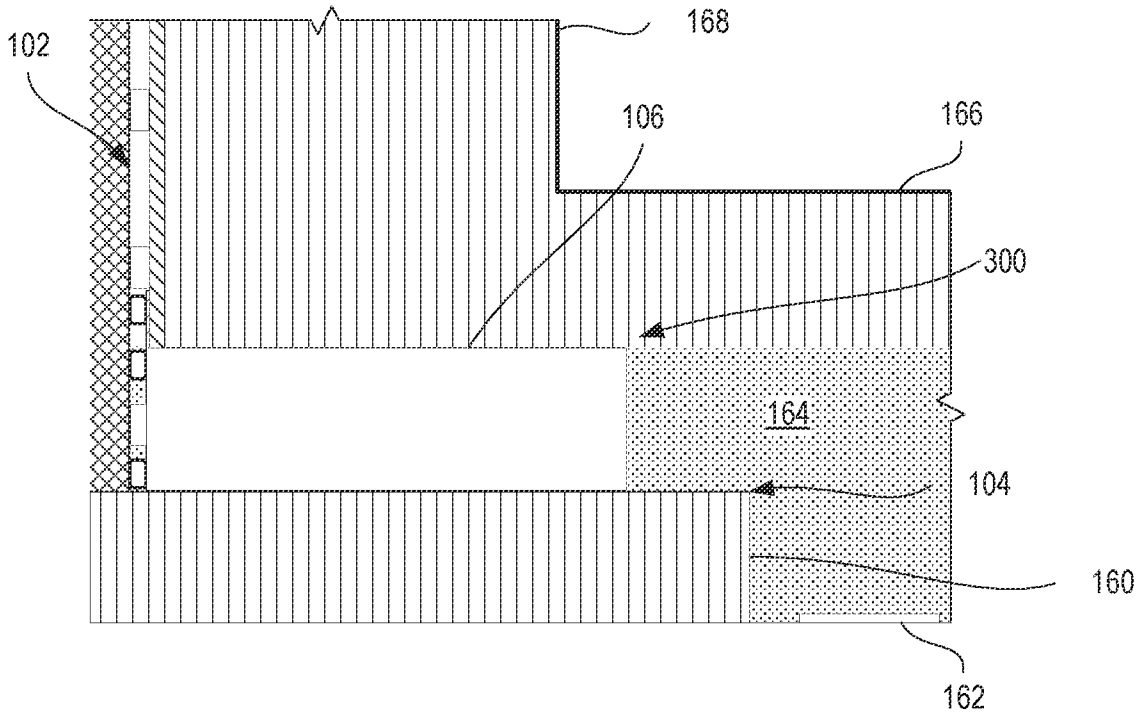
FIG. 6 is a schematic partial cross-sectional view of a bottom of a finished building with a drainage system installed against a smooth wall, in accordance with an embodiment.

FIG. 6 is a schematic partial cross-sectional view of bottom of a finished building with a drainage system 300 installed against a smooth wall 102, in accordance with an embodiment. The cross-section is taken through the elongated body 106 of the drainage device 100. The drainage device 100 may be attached, adhered, or fastened to a concrete footing 160 formed over soil at the foundation of the finished building. The drainage device 100 may be fluidly connected to a drain 162 via a flow-through region 164. The drain 162 may connect to a sump, from where the fluid is pumped out. The flow-through region 164 may include gravel, sand, and/or other materials allow water to flow therethrough. A finished concrete floor 166 and a finished concrete wall 168 may be formed over the drainage device 100, e.g. by pouring or spraying concrete thereon.

As can be understood, the examples described above and illustrated are intended to be exemplary only.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, the side flanges may extend only partially between the rearward and forward ends, the side flanges may be small tabs, and the rear flange may have a dimpled backing or otherwise be dimpled while being adhesively coupled to a barrier that has no dimpled backing. Yet further modifications could be implemented by a person of ordinary skill in the art in view of the present disclosure, which modifications would be within the scope of the present technology.

What is claimed is:

1. A drainage device for draining moisture, comprising:

an elongated body extending between forward and rearward ends of the elongated body along opposing sides of the elongated body, the elongated body defining an arcuate cross-section as viewed from the forward end and rearward ends such that the elongated body defines an open bottom extending between the opposing sides;

a pair of side flanges extending from the elongated body along the opposing sides from the rearward end toward the forward end, the pair of side flanges configured to attach the drainage device to a floor; and a rear flange extending arcuately around a circumferential length of the elongated body at the rearward end, the rear flange configured to be disposed against a wall adjacent to and projecting from the floor;

wherein each side flange of the pair of side flanges projects away from a lower portion of the elongated body in opposing directions substantially within a bottom plane defined by the open bottom, the bottom plane being substantially perpendicular to the lower portion, substantially perpendicular to a forward plane defined by the forward end, and substantially perpendicular to a rearward plane defined by the rearward end, and each side flange of the pair of side flanges extends an entire length of the elongated body from the rearward end to the forward end.

2. The drainage device of claim 1, wherein the rear flange includes a spacer above the elongated body projecting laterally away from a face of the rear flange and from the elongated body, the spacer being suitable for spacing the elongated body away from the wall when the rear flange is disposed against the wall.

3. The drainage device of claim 1, wherein the rear flange includes a dimpled backing defining a plurality of protrusions projecting laterally away from a face of the rear flange and from the elongated body, at least one protrusion of the plurality of protrusions being formed above the elongated body, the dimpled backing being suitable for spacing the elongated body away from the wall when the rear flange is disposed against the wall.

4. The drainage device of claim 1, wherein each side flange is dimensioned to receive a plurality of fasteners to fasten the elongated body to the floor.

5. The drainage device of claim 1, wherein the arcuate cross-section is substantially U-shaped.

6. The drainage device of claim 1, wherein the arcuate cross-section is substantially parabolically shaped.

7. The drainage device of claim 1, wherein the elongated body defines a semicylindrical surface.

8. The drainage device of claim 1, wherein each side flange is suitable for receiving adhesive to adhere the elongated body to the floor.

9. A drainage system, comprising:

a drainage device configured for draining moisture from a wall that is adjacent to and projects from a floor, the drainage device comprising:

a U-shaped elongated body extending between forward and rearward ends of the elongated body along opposing sides of the elongated body, the elongated body extending arcuately above the floor between the opposing sides disposed on and attached to the floor to define an open bottom extending between the opposing sides such that a channel between the elongated body and the floor receives moisture from proximate the wall at the rearward end;

a pair of side flanges extending from the elongated body along the opposing sides from the rearward end toward the forward end, the pair of side flanges being attached to the floor, each side flange of the pair of side flanges projecting away from a lower portion of the elongated body adjacent to the open bottom in opposing directions substantially within a bottom plane defined by the open bottom, the bottom plane being substantially perpendicular to the lower portion, substantially perpendicular to a forward plane defined by the forward end, and substantially perpendicular to a rearward plane defined by the rearward end, and each side flange of the pair of side flanges extends an entire length of the elongated body from the rearward end to the forward end; and a rear flange extending around a circumferential length of the elongated body at the rearward end, the rear flange being dimensioned to be captively received between the wall and the barrier via the opening for allowing the moisture between the barrier and the wall to drain into the channel via the rearward end; and a discrete barrier positioned proximate the wall, the barrier having an opening substantially parallel to the wall adjacent to the floor that is dimensioned complementarily to receive the elongated body of the drainage device therein.

10. The drainage system of claim 9, wherein the barrier is substantially parallel to the wall and includes a dimpled backing defining a plurality of protrusions projecting laterally from a face of the barrier to space the face of the barrier away from the wall.

11. The drainage system of claim 9, wherein the rear flange includes a dimpled backing defining a plurality of protrusions projecting laterally away from a face of the rear flange and from the elongated body towards the wall, the dimpled backing spacing the elongated body away from the wall when the rear flange is disposed against the wall.

12. The drainage system of claim 9, wherein the elongated body extends substantially perpendicular to the wall such that the channel extends laterally away from the wall for draining the moisture away from the wall, and wherein a face of the rear flange is substantially parallel to the wall.

13. The drainage system of claim 9, wherein the rear flange extends arcuately and substantially completely around a circumferential length of the elongated body at the rearward end of the elongated body.

14. The drainage system of claim 9, wherein the elongated body defines an arcuate cross-section as viewed from the forward and rearward ends.

15. The drainage system of claim 9, wherein the elongated body defines an arcuate cross-section as viewed from the rearward end, the opening of the barrier being shaped to receive the elongated body at the rearward end of the elongated body.

16. The drainage system of claim 15, wherein the rear flange is adjacent a non-opening portion of the barrier when the elongated body is received into the opening.

17. A method of draining moisture at a wall adjacent to and projecting from a floor, the method comprising:

providing the drainage device of claim 1;

attaching to the floor an elongated body extending between forward and rearward ends of the elongated body along opposing sides of the elongated body using a pair of side flanges extending from the elongated body along the opposing sides from the rearward end of the elongated body towards the forward end, when the elongated body is positioned on the floor such that the rearward end is proximal to the wall and the elongated body extends arcuately above the floor to define a channel between the elongated body and the floor; and captively receiving, between the wall and a barrier, a rear flange extending arcuately around the elongated body at the rearward end of the elongated body by disposing of a barrier proximate to the wall when the barrier has an opening to the wall adjacent the floor that is dimensioned complementarily to the elongated body for receiving the elongated body into the opening.

18. The method of claim 17, further comprising:

adhering a face of the rear flange to the barrier using a sealant to form a seal.

* * * * *